US006241486B1

(12) United States Patent
Sloteman

(10) Patent No.: US 6,241,486 B1
(45) Date of Patent: Jun. 5, 2001

(54) COMPACT SEALLESS SCREW PUMP

(75) Inventor: Donald P. Sloteman, New Hope, PA (US)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 09/044,055

(22) Filed: Mar. 18, 1998

(51) Int. Cl.[7] ..... F04B 17/00
(52) U.S. Cl. ..... 417/370; 417/410.4
(58) Field of Search ..... 417/370, 410.4; 416/223 R, 228, 235

(56) References Cited

U.S. PATENT DOCUMENTS

| | | | | |
|---|---|---|---|---|
| 2,368,572 | | 1/1945 | Say | 103/4 |
| 2,994,562 | | 8/1961 | Zalis | 302/14 |
| 3,572,982 | * | 3/1971 | Kozdon | 417/423 |
| 3,667,879 | | 6/1972 | Cerpelli | 418/202 |
| 3,804,565 | | 4/1974 | Sennet et al. | 418/201 |
| 4,329,126 | | 5/1982 | Nishimura | 418/1 |
| 4,420,291 | | 12/1983 | Winstead | 417/338 |
| 4,684,335 | * | 8/1987 | Goodridge | 418/189 |
| 4,808,087 | * | 2/1989 | Tsutsui et al. | 417/369 |
| 4,952,122 | | 8/1990 | Iida et al. | 417/356 |
| 4,969,803 | * | 11/1990 | Turanskyj | 417/247 |
| 5,028,222 | | 7/1991 | Iida et al. | 418/220 |
| 5,045,026 | | 9/1991 | Buse | 464/29 |
| 5,090,874 | | 2/1992 | Aikawa et al. | 417/356 |
| 5,090,875 | | 2/1992 | Aikawa et al. | 417/356 |
| 5,100,307 | | 3/1992 | Arita et al. | 418/15 |
| 5,151,021 | | 9/1992 | Fujiwara et al. | 418/93 |
| 5,190,450 | | 3/1993 | Ghosh et al. | 418/189 |
| 5,269,664 | | 12/1993 | Buse | 417/360 |
| 5,295,808 | | 3/1994 | Machida et al. | 417/366 |
| 5,297,940 | | 3/1994 | Buse | 417/63 |
| 5,348,453 | | 9/1994 | Baran et al. | 417/440 |
| 5,378,128 | | 1/1995 | Yanagisawa | 418/9 |
| 5,646,466 | | 7/1997 | Noji et al. | 310/112 |
| 5,674,063 | * | 10/1997 | Ozaki et al. | 418/201.3 |
| 5,695,327 | | 12/1997 | Heinen et al. | 418/144 |

FOREIGN PATENT DOCUMENTS

| | | | |
|---|---|---|---|
| 0481423A1 | 4/1992 | (EP) . | |
| 0697523A2 | 2/1996 | (EP) | 18/16 |
| 0697523A3 | 4/1996 | (EP) | 18/16 |
| 0733803A2 | 9/1996 | (EP) . | |
| 0733803A3 | 1/1998 | (EP) . | |
| 1001072 | 5/1962 | (GB) . | |
| 2123089A | 1/1984 | (GB) | 2/14 |
| WO 91/16537 | 10/1991 | (WO) | 37/18 |

* cited by examiner

*Primary Examiner*—Timothy S. Thorpe
*Assistant Examiner*—Timothy P. Solak
(74) *Attorney, Agent, or Firm*—Killworth, Gottman, Hagan & Schaeff, L.L.P.

(57) ABSTRACT

A screw pump, includes a pump case having a fluid inlet, a pumping chamber, and a fluid discharge with at least two intermeshed parallel screw members rotatably mounted therein and in fluid communication with the fluid inlet and the fluid discharge. One synchronous electric drive motor mounted to each screw member provides the driving power to the screws. Electronic controls are provided for sensing the rotary positions of the motors for synchronizing rotation of the screw members. The pump is also capable of pumping multi-phase fluids.

9 Claims, 3 Drawing Sheets

COMPACT SEALLESS SCREW PUMP

BACKGROUND OF THE INVENTION

This invention relates generally to screw pumps and more particularly to sealless screw pumps for multi-phase undersea pumping from offshore oil wells, for surface platform mounting at such wells, and for high pressure pumping of single-phase viscous fluids.

Screw pumps usually consist of two or more oppositely handed parallel screws or augers with intermeshed flights which rotate within a pumping chamber to create a number of axially moving sealed pockets between their flights. These pockets transport product from the suction port to the discharge port of the pump. Sealing discharge pressure from suction pressure is accomplished by the extent of the radial clearance between the screws and the mating bore as well as by the locking of the intermeshed flights. Their mechanical simplicity, reliability, and compactness provide significant value to users. Multiphase fluids such as mixtures of gas and oil are easily accommodated by rotary screw pumps.

Typically, screw pumps are equipped with a set of timing gears for transmitting torque from a single drive motor to both screws. One screw has an extended shaft that is coupled to the drive motor, such that torque from the drive motor is transmitted through the shaft to a set of the timing gears to synchronously drive both screws. The timing gears serve to avoid potentially damaging contact between the screws; however, they require an oil system for proper lubrication to avoid damage to the timing gears themselves. A shaft sealing arrangement is also required to prevent infiltration of the working fluid into the lubricating oil and loss of lubricating oil. The drive motors are usually induction motors which are sealed for undersea applications and explosion proof for surface applications.

In undersea duty, the sealed motor is typically cooled by seawater, which requires that both the motor and the coupling to the extended screw shaft be sealed from the pumped product as well as the surrounding seawater. Alternatively, motor cooling can be provided by the oil system of the timing gears via the rotor/stator interface of the motor. The use of shaft seals, oil systems, timing gears, and mechanical couplings introduce significant mechanical complexities which adversely affect reliability and cost. Moreover, any repair to a sea bottom pump is very expensive in terms of downtime and the cost of specialized recovery and repair equipment.

The foregoing illustrates limitations known to exist in present single-phase and multi-phase screw pumps. Thus, it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by a screw pump, comprising a pump case having a fluid inlet, a pumping chamber, and a fluid discharge; at least two oppositely-handed intermeshed parallel screw members rotatably mounted within said pumping chamber and in fluid communication with said fluid inlet and said fluid discharge; one synchronous electric drive motor mounted to each said screw member; and electronic control means incorporated into a polyphase inverter for sensing rotary positions of said motors and for synchronizing rotation of said screw members.

The foregoing and other aspects will become apparent from the following detailed description of the invention when considered in conjunction with the accompanying drawings.

DETAILED DESCRIPTION

Sealless pumps are well known in the art. U. S. Patents to Buse, U.S. Pat. No. 5,045,026, issued Sep. 3, 1991, U.S. Pat. No. 5,269,664, issued Dec. 14, 1993, and U.S. Pat. No. 5,297,940, issued Mar. 29, 1994, all disclose features of sealless magnetically coupled pumps. Co-pending and commonly assigned U.S. patent application Ser. No. 08/037,082 of Sloteman, et al., also adds to the art of sealless magnetically coupled pumps. The disclosures of these patents and the co-pending application are incorporated herein, by reference, to illustrate the known art of magnetically coupled sealless pumps.

Figure 1:
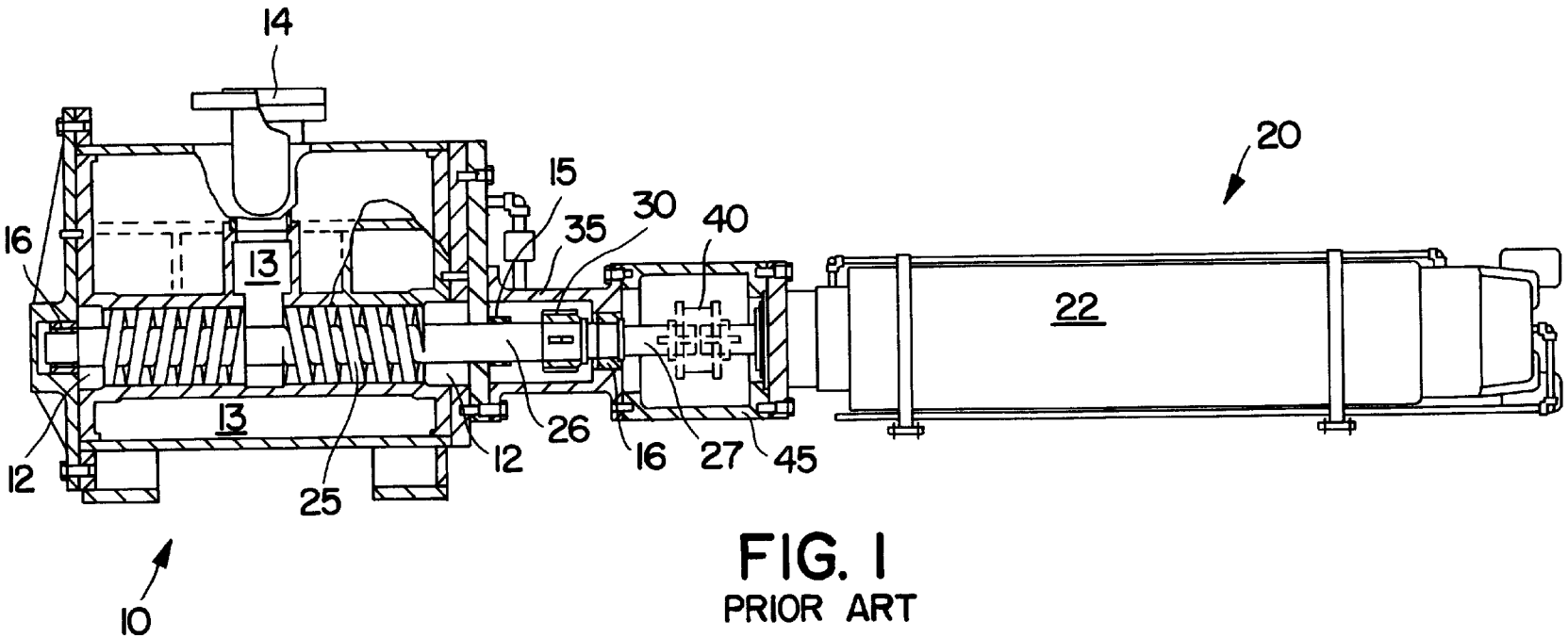
FIG. 1 PRIOR ART
FIG. 1 is a schematic longitudinal partially sectional elevation view of a conventional screw pump of current design.

FIG. 1 shows a conventional screw pump of the prior art, which consists of the screw pump body 10 and a sealed motor 20 coupled together by a sealed shaft coupling 40.

The pump body has an inlet chamber 12 and a discharge chamber 13, connected by a pumping chamber with two parallel oppositely handed intermeshed screws 25 for transporting fluid product from the inlet 12 to the discharge chamber 13 for discharge through the pump body outlet 14. The screws 25 are supported by sealed and usually oil-lubricated bearings 16. One screw 25 has an extended shaft 27 for connecting to the drive motor 20 through the sealed shaft coupling 40. Both screws have shafts 26 with intermeshing timing gears 30 for positively controlling the timing of the rotation of the screws 25 to prevent damaging contact between them. The timing gears 30 are housed in a sealed gear case 35 fixed to the end of the pump body 10. A seal 15 between the pump body 10 and the shaft 26 for each screw 25 excludes the working fluid from the case 35 and retains the lubricating gear oil within the case. An extension case 45 houses the coupling 40 for transmitting power from the motor 20 to the pump 10. The drive motor 20 has a sealed shell 22 which isolates the motor components from the surrounding environment to provide explosion proofing and water protection for the electrical components of the motor.

Cooling usually requires transfer of heat to the surrounding sea water, which usually serves as the ultimate heat sink. This may be done by providing cooling fins on any or all of the motor case 22, the gear case 35, the extension case 45, and the pump case 10. It may also be done by pumping oil through the motor 20, to cool the motor, and then through a sea water cooled heat exchanger (not shown) to cool the oil. Of course, cooling requirements will depend upon the temperature of the pumped product, the temperature of the sea water, and the heat generated by the operation of the motor and pump.

Figure 2:
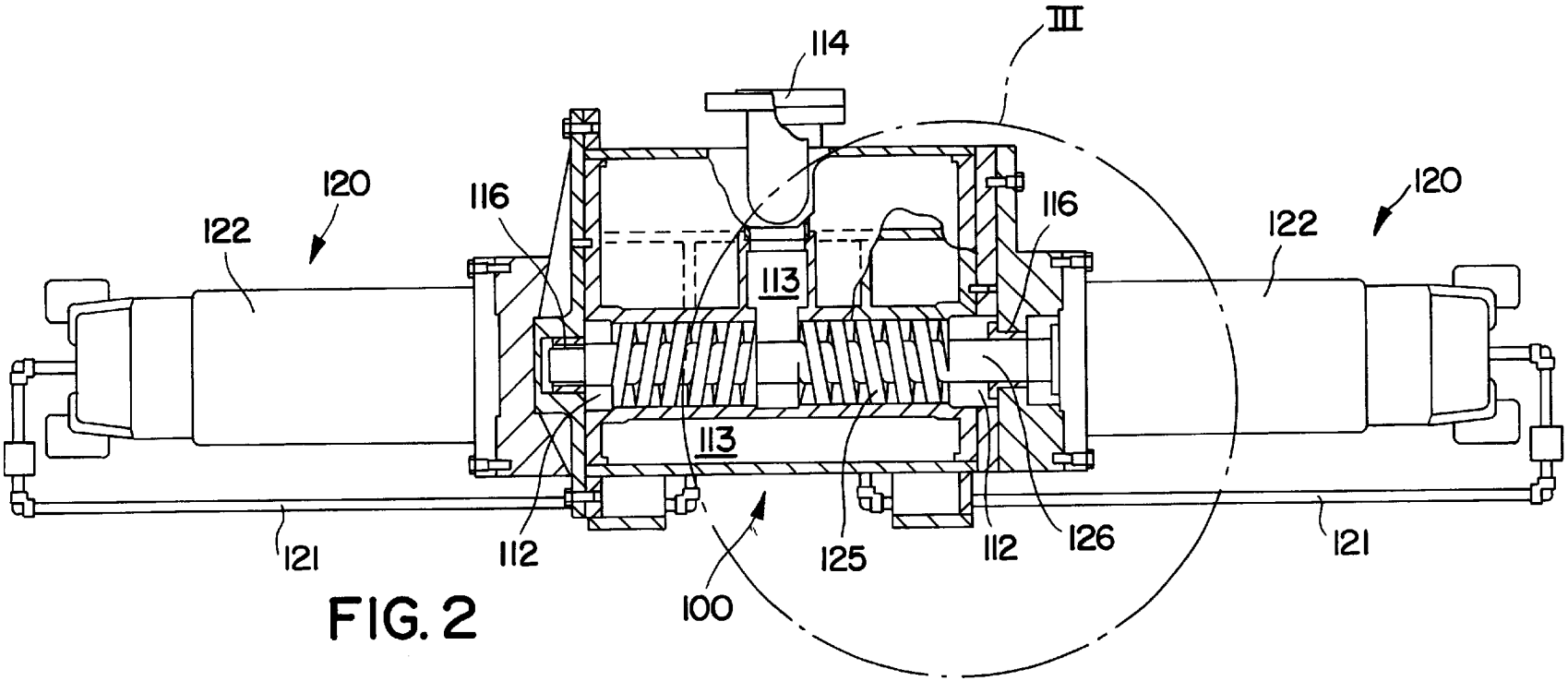
FIG. 2 is a schematic longitudinal partially sectional elevation view of a screw pump according to the invention.
Figure 3:
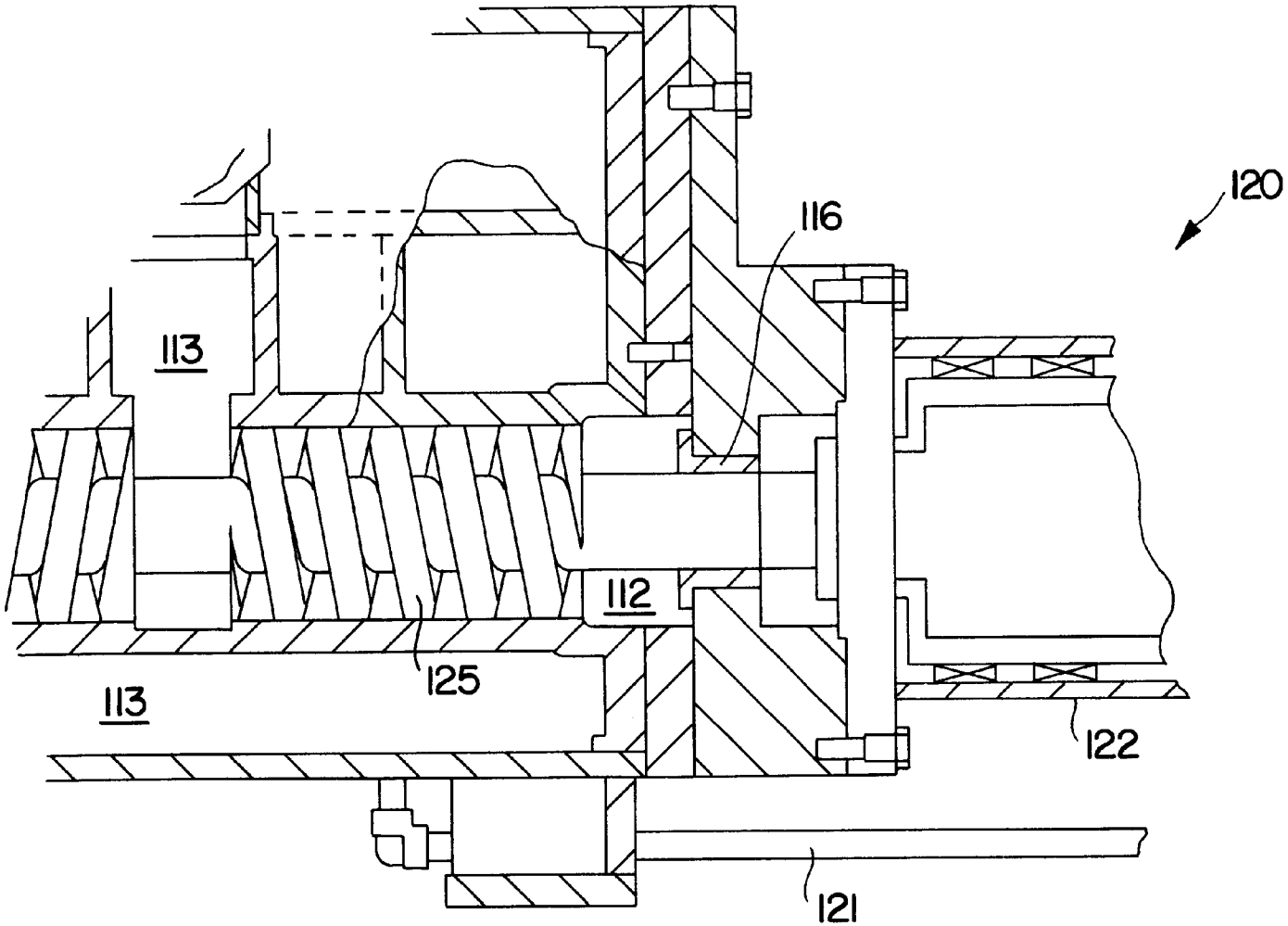
FIG. 3 is an enlarged view of a portion of the pump enclosed in the area designated III in FIG. 2.

FIG. 2 and, with greater detail, FIG. 3 shows a twin-screw sealless pump according to the invention. It has a pump housing 100 with a fluid inlet chamber 112, a fluid discharge chamber 113, and a fluid outlet 114. The two oppositely handed and intermeshed screws 125, with extended shafts 126, are mounted in the pumping chamber between the fluid inlet chamber 112 and the fluid discharge chamber 113 by bearings 116 which may be sealed and oil lubricated but are preferably lubricated by the pumped product. Each screw 125 is driven by an individual synchronous electric motor 120 housed in a motor case 122. Preferably, permanent magnet brushless direct current type motors are employed; because they are capable of providing higher torque for a given physical size and provide excellent position feedback targets in the magnets mounted on the rotor. Any adequately powered synchronous electric motor will suffice, so long as it can be properly sealed and cooled. The motors are electronically synchronized by sensing rotor positions from information on the motor phase leads coming from the back emf generated by the motor and using that to control the invertor commutation to the motor stator. This electronic synchronization of the motors allows operation of the intermeshed screws without need for the timing gears, with their attendant lubrication requirements, which are required for the prior art screw pump of FIG. 1. Alternatively, sensors mounted on or near the stator in each motor 120 can monitor the rotor position by sensing the rotor magnets and thereby provide the precise positional information needed to synchronize the screws 125. Such electronic motor control is widely practiced in systems requiring precise motion control, such as robotics systems.

Since many screw pumps are applied to pumping hydrocarbon-bearing fluids from undersea wells, multiphase fluid (fluid comprising mixed gaseous and liquid phases) is frequently encountered. Sometimes the phases are mixed within the well, and sometimes the gaseous phase forms by cavitation of high vapor-pressure liquid at the inlet to the pumping chamber. At high gas void fractions, pumping efficiency can be improved by providing a pump embodiment in which the screw pitches are reduced (this is not illustrated but is well known in the art) at an intermediate point in the pumping chamber. This has the effect of providing fluid to that intermediate point at a volume flow rate greater than that at which it is being pumped beyond that point. Any gases present become compressed and pass through the chamber; however, to avoid so called liquid lock-up and possibly damage to the pump when no gas is present, a vent passage is provided at the intermediate point through the wall of the pumping chamber to the fluid inlet chamber 112. An adjustable pressure control device in the vent passage controls the minimum pressure at which venting will occur and thus the maximum pressure exerted on the walls of the pumping chamber.

If the diameter of the screws 125 is large enough relative to that of the motors, the motors 120 can both be mounted on the same side of the pump case 100 of the machine. If the screw diameters are too small, the motors 120 can be mounted on opposite ends of the pump case 100. In either case, the motor may be cooled by diverting pumped product from the pump discharge chamber 113 to the motor case 122. It then travels through passages, within the motor case 122, between the canned rotor and an inside surface of the stator and returns to the inlet chamber 112 through conduit 121. The pumped product may be passed through a heat exchanger (not shown) to be cooled by sea water before introducing it into the motor case 122. During periods when pumping large amounts of gas, motor heat rejection is accomplished by passing seawater over the motor casing. Primary cooling can also be accomplished by passing sea water over an outside surface of the stator can within the motor casing. In no case is the pumped product or the sea water permitted to contact internal motor components.

By using product lubricated bearings 116, made from a material compatible with the pumped product and hard enough to resist abrasion wear due to entrained particles, the need for lubricating oil or grease is eliminated. The bearing material must be capable of running in a nearly dry condition for extended periods of time in the event of encountering large volumes of pumped gas. Since the rotor and stator are canned, they may be fully exposed to the pumped product, so no seals are needed. Also, the motor rotor may be directly mounted to the screw shaft 126 with no coupling needed.

Elimination of the timing gears and their associated lubrication system alone represents a significant simplification and attendant cost and reliability improvement for such pumps. Use of product lubricated bearings and elimination of shaft seals by canning the rotors and stators also provides a number of possible motor cooling alternatives. The shaft mounted motors eliminate the need for shaft couplings. Use of permanent magnet brushless DC type motors permits use of smaller size motors for a given pumping capacity and improves the ease of canning the rotors and stators.

Having described the invention, I claim:

1. A screw pump, comprising:

a pump case having a fluid inlet, a pumping chamber, and a fluid discharge;

at least two oppositely-handed intermeshed parallel screw members rotatably mounted within said pumping chamber and in fluid communication with said fluid inlet and said fluid discharge;

one synchronous electric drive permanent magnet brushless direct-current type motor mounted to each said screw member; and electronic control means incorporated into a polyphase inverter for sensing rotary positions of said permanent magnet brushless direct-current motors to synchronize rotation of said screw members without the use of timing gears.

2. The screw pump of claim 1, further comprising:

bearings for rotatably supporting said screw members in said pumping chamber, said bearings being lubricated by pumped product.

3. The screw pump of claim 1, wherein each said drive motor is sealless and has a canned rotor immersed in pumped product.

4. The screw pump of claim 3, wherein the stator of each said drive motor is also canned and is exposed to the pumped product.

5. The screw pump of claim 4, wherein an outside surface of the canned stator is cooled by exposure to sea water.

6. The screw pump of claim 1, further comprising:

means for diverting a portion of pumped product from said fluid discharge through said motor and thence to said fluid inlet to extract waste heat from said motor.

7. The screw pump of claim 6, wherein the means for diverting a portion of pumped product includes a heat exchanger for rejecting heat from said pumped product to surrounding sea water.

8. The screw pump of claim 1, further comprising:

a decrease of screw pitch of said screw members between said fluid inlet and said fluid discharge;

a vent passage from said pumping chamber to said fluid inlet adjacent to said decrease of screw pitch to prevent liquid lock-up; and a pressure control device in said vent passage for setting a minimum pressure at which venting can occur.

9. A screw pump, comprising:

a pump case having a fluid inlet, a pumping chamber, and a fluid discharge;

at least two oppositely-handed intermeshed parallel screw members rotatably mounted within said pumping chamber and in fluid communication with said fluid inlet and said fluid outlet, said screw members having a reduction of screw pitch at an intermediate section of said pumping chamber;

means in said pumping chamber for preventing liquid lock-up due to said reduction of screw pitch;

one permanent magnet direct-current brushless synchronous drive electric motor mounted to each said screw member; and electronic control means for sensing rotary positions of permanent magnets in said motors to synchronize rotation of said screw members without the use of timing gears.

* * * * *